US008721509B1

(12) United States Patent
Berdut-Teruel

(10) Patent No.: US 8,721,509 B1
(45) Date of Patent: May 13, 2014

(54) TILTABLE MULTI-PURPOSE VARIABLE RESISTANCE EXERCISE GYM APPARATUS

(71) Applicant: Elberto Berdut-Teruel, San Juan, PR (US)

(72) Inventor: Elberto Berdut-Teruel, San Juan, PR (US)

( * ) Notice: Subject to any disclaimer, the term of this patent is extended or adjusted under 35 U.S.C. 154(b) by 0 days.

(21) Appl. No.: 13/961,462

(22) Filed: Aug. 7, 2013

(51) Int. Cl.
*A63B 21/068* (2006.01)
*A63B 21/04* (2006.01)
*A63B 22/20* (2006.01)

(52) U.S. Cl.
USPC ..... 482/121; 482/96; 482/130; 482/142

(58) Field of Classification Search
USPC ..... 482/51, 72, 95–96, 121–129, 140–142
See application file for complete search history.

(56) References Cited

U.S. PATENT DOCUMENTS

| | | | | |
|---|---|---|---|---|
| 5,674,168 | A * | 10/1997 | Wilkinson | 482/138 |
| 5,752,879 | A * | 5/1998 | Berdut | 482/96 |
| 6,168,554 | B1 * | 1/2001 | Berg et al. | 482/70 |
| 7,731,637 | B2 * | 6/2010 | D'Eredita | 482/72 |
| 8,235,874 | B2 * | 8/2012 | D'Eredita | 482/72 |

* cited by examiner

*Primary Examiner* — Stephen Crow
(74) *Attorney, Agent, or Firm* — Luis Figarella

(57) ABSTRACT

A table is slidably supported on a chassis which is tiltably supported on a base or support frame whose angle may be adjustable via a motorized tilt control device that allows the chassis and table to be tilted and the weight of the user made available to produce a load against which exercising can be carried out. Said weight may be increased by the addition of one or more elastic resistance bands at various geometric points of said slidable supported device and the fixed base on which it is mounted, and whose geometry serves to apply a pre-tension force to said band(s). By pre-tensioning the material, the resistance band then provides a more linear force to the end user.

7 Claims, 8 Drawing Sheets

TILTABLE MULTI-PURPOSE VARIABLE RESISTANCE EXERCISE GYM APPARATUS

PATENTS CITED

The following documents and references are incorporated by reference in their entirety, Berdut (U.S. Pat. No. 5,752,879), Frick et al (U.S. Pat. No. 6,527,676), Barnett (U.S. Pat. No. 8,012,073), Boren (U.S. Pat. No. 8,012,073), Solow (U.S. Pat. No. 8,394,005), and Hetrick (U.S. Pat. No. 8,469,864).

FIELD OF THE INVENTION

The present invention relates to an item of exercise equipment which enables a user to perform a plurality of different exercises. More specifically, the present invention relates to exercise equipment in which the user may selectively utilize a combination of the weight of the user and/or variable resistance straps to provide a load against which the person exercises and which varies the load simply by changing the angle of either the apparatus and/or the straps.

DESCRIPTION OF THE RELATED ART

A great many and various types of exercise apparatus have been proposed. A large number of these devices have relied solely upon springs, weights or even elastomeric members to provide resistance against which exercise can be performed. Other devices have attempted to make use of the body weight of the person in order to provide an exercise resistance, but have been limited to one or two different bench-press and riding types of exercises.

The above types of machines are intended for use by people who are in good health and wish to improve their physical condition; however, they are usually not suited for elderly and disabled people such as those who suffer from muscular dystrophy, or who have spinal or heart problems, for example.

There is a need for exercise equipment which is simple, sturdy, allows a good variety of different exercises to be performed, and which is readily adjustable.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

In one aspect the invention is about an exercising machine comprising a support frame, a chassis supported on said support frame so as to be selectively tiltable at an angle with respect to a horizontal plane, a motorized tilt control arrangement which controls the angle of inclination of the combined chassis and table arrangement, said angle adjustment device interconnecting said support frame and said chassis and maintaining a selected tilt angle of said chassis with respect to the horizontal plane, a slidable table slidably supported on the tiltable chassis, said table being adapted to support a person and to be tiltable at the same angle as said chassis, a pair of oar anchor brackets which are fastened to each side of said chassis, said oar anchor brackets having connection means which enables the lower ends of oars to be pivotally connected to said chassis and one or more table hooks positions along the side of said table and one or more hook positions along the length of said angle connector, with at least one adjustable resistance band connecting one said table hook position to one said position along said angle connector.

In another aspect said table is supported on said chassis by a plurality of rollers, and wherein said chassis is provided with rail means on which said rollers can roll. In yet another aspect, said rollers are arranged in sets wherein a plurality of rollers of each set are arranged to roll on top of a rail of said rail means, and at least one roller of each set is arranged to roll on a lower side of the rail.

Other features and advantages of the present invention will become apparent upon examining the following detailed description of an embodiment thereof, taken in conjunction with the attached drawings.

Figure 1:
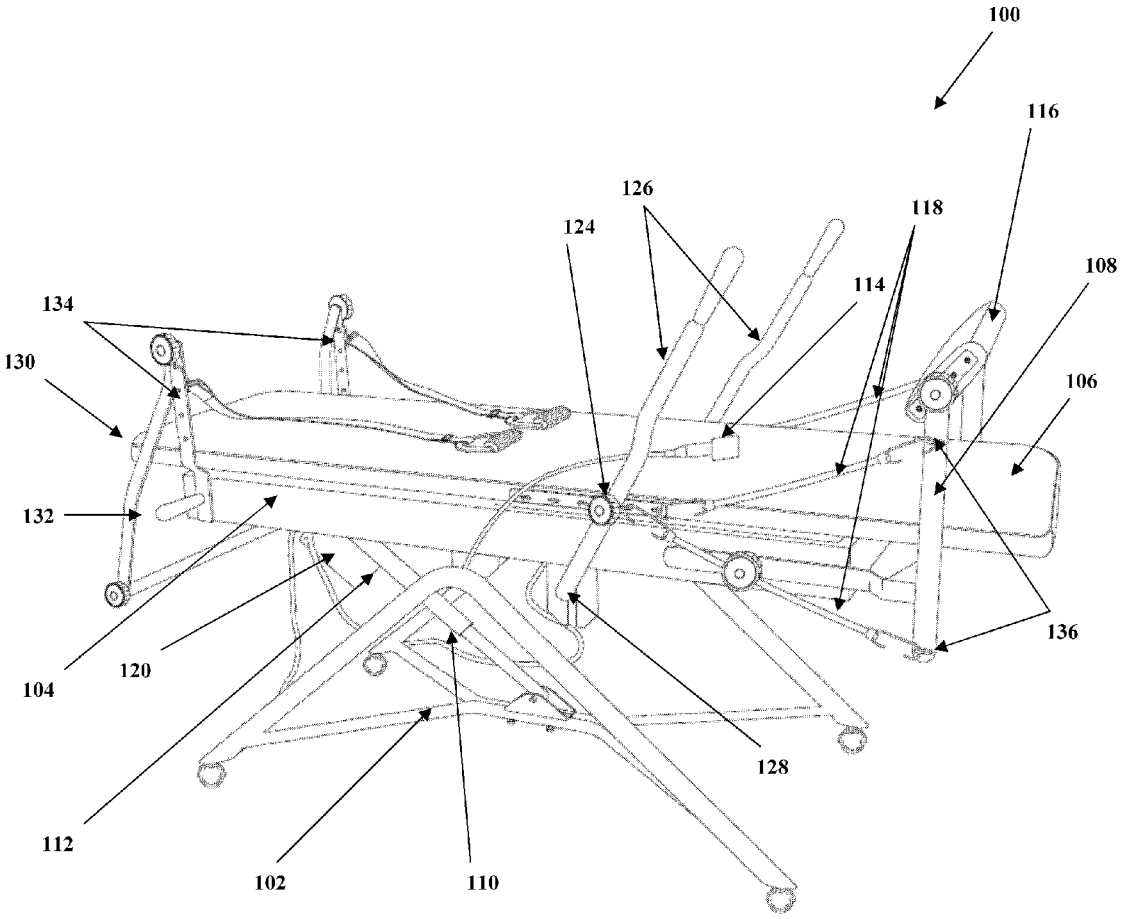
FIG. 1 shows an illustration of a perspective view of the Tiltable multi-purpose variable resistance exercise gym apparatus, according to an exemplary embodiment of the invention.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

FIGS. 1-6 illustrate the concept upon which the present invention is based. As will be readily appreciated from these sketches, the invention 100 is quite simple in its physical construction and comprises five basic elements: a base or support frame 102; a tiltable chassis 104 which is pivotally supported on said base frame 102; a bed or table 106 which is slidably supported on the tiltable chassis 104; an adjustable resistance angle connector 108 and a motorized tilt control arrangement 110 which controls the inclination of the combined chassis and table arrangement.

The table 106 and chassis 104 are arranged to be tiltable in both directions through a motor/screw combination 112 to a maximum angle which is set in one embodiment at 45° either way, but may be set to any angle up to 90°. In one embodiment, the motor/screw combination 112 is under the control of a hand-held remote controller unit 114.

Figure 2:
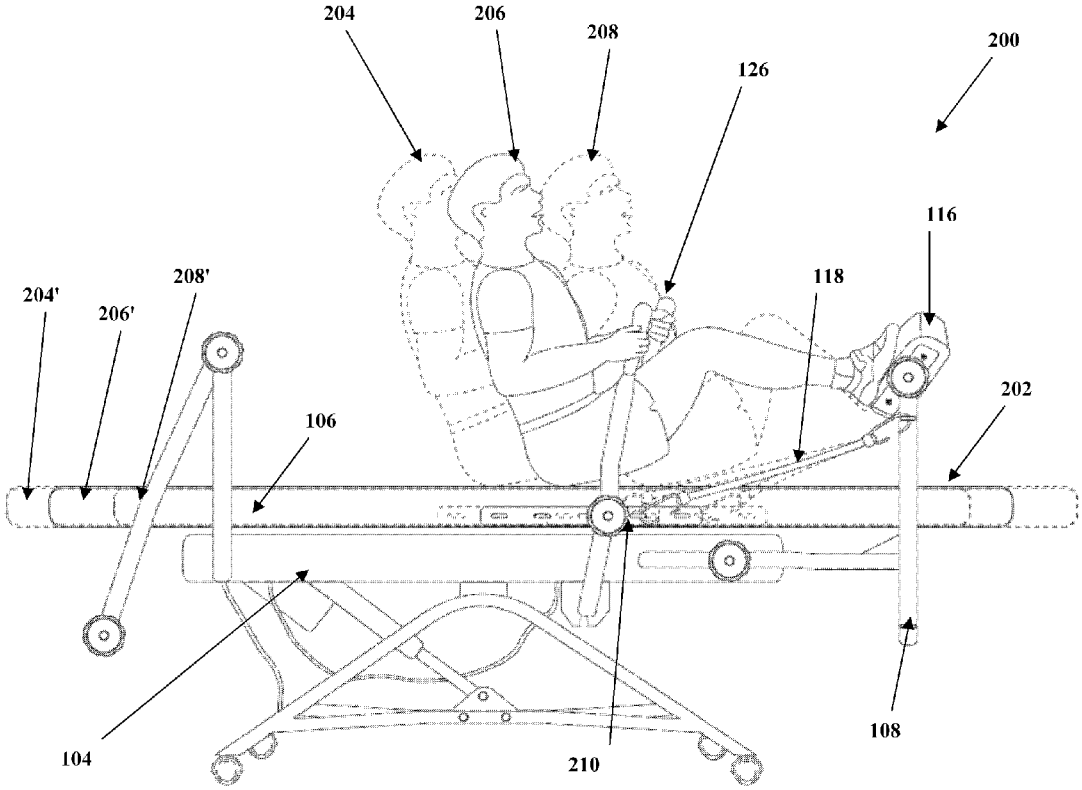
FIG. 2 is a side elevation showing a user in a backward tiltable positions (using part of his weight as resistance), having it augmented by the addition of a variable resistance band between the slidable table and the base, according to an exemplary embodiment of the invention.
Figure 3:
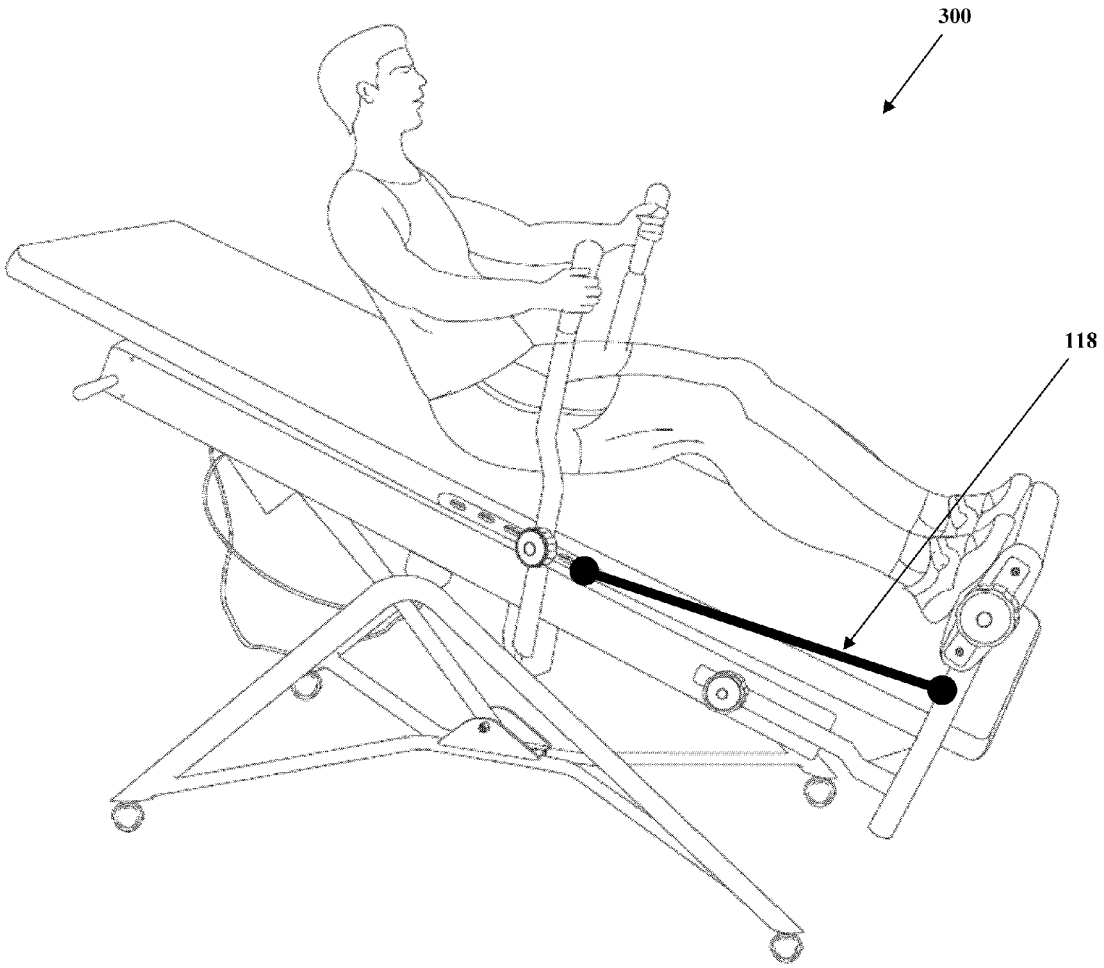
FIG. 3 shows an illustration of a perspective view of a user rowing on the tiltable multi-purpose variable resistance exercise gym apparatus, according to an exemplary embodiment of the invention.

By tilting the table 106, it is possible to employ the body weight of the person using the apparatus to provide a load against which exercise can be carried out. As seen in FIG. 2, the table 106 is inclined so that the "foot" end (F/E or 202) of the table elevated above the horizontal plane, and the padded foot rest 116 arrangement connected to the chassis by way of wing nuts or the like. In one embodiment these nuts are depicted as having triangular heads and are provided on both the chassis 104 and the table 106 to enable the foot rest 116 to be connected to either.

In one embodiment, the foot rest 116 is provided with toe caps which allow the user to secure his or her feet against the foot rest 116 and thus be able to apply a traction force which acts on the muscles in the upper thigh and holds the slidable table 106 in position. By increasing the angle of tilt using the remote control unit 114, the amount of resistance can increased from a near zero level when the table and chassis are horizontal, to a considerable amount when the maximum degree of inclination is reached. It should be noted that the angle through which tilting is possible is not limited to the above mentioned value and that the amount of tilt can be increased to any practical maximum value.

FIG. 2 shows the foot rest 116 that is connected to the un-moveable chassis 104 having the moveable table 106, whose foot end 202 of moves through the motion of the user 206 in one end 204 and another 208, which are represented at points 206', 204' and 208' respectively. When the table is flat, one or more elastic bands 118 may be connected to the one or more table hooks positions 210 along the table designed to connect via one or more bands 118 to the one or more hook positions 136 along the adjustable angle connector hook positions 136 along the adjustable resistance angle connector 108. In this fashion, the user may use the levers or handles 126 that are connected to the base frame's 102 oar anchor pins 128 which allows the user to pull his or her body weight up the slope in a manner which enables a "dead lift" exercise to be carried out, to do it in a flat position against the bands 118 and or a combination of both FIG. 3.

For the purpose of the present invention, it is appreciated that the elastic element may be comprised of a variety of different forms. For example, the elastic element or bands 118 may be a band, tube, or like resistive element. In one embodiment, said bands comprise tubes that are generally two feet long and terminate at a fabric coupling at each end, so that each coupling has a loop to attach a metal clip, e.g. carabineer, which can be releasably attached to an attachment ring, or handle or other implement. The coupling material may comprise a e.g. heavy nylon webbing or the like material that is capable of withstanding large tensile loads.

A desired pre-set tension may independently be applied to each of the bands 118 by selecting an appropriate length of band material, or selecting the movable table hook position 210 and the respective angle hook connector positions 136. In this regard, a preferred band material is made of synthetic rubber materials such as latex or other elastomeric rubber-like materials. Alternatively, a length of band 118 may be connected to the first table hook position 210 of the bed and secured to the highest point in the angle hook connector 136.

In one embodiment, certain combinations of table hook 210 to angle hook 136 may be color coded, or numbered to represent 1X, 3X, 5X resistance where X is a particular color. The elastic elements may be provided as a set of elastic tubes that have different colors: e.g. yellow, green, red and blue, each color corresponding to a different resistance. Two or three elastic tubes can be attached to one handle and attachment point of pull on the system, so that a user can combine red and green on handle for more resistance, or any other combinations of colors. Although the elastic elements are preferred, it is appreciate that any elastic element, e.g. band, tubing or the like, currently available in the art may be used in the present invention.

Figure 4:
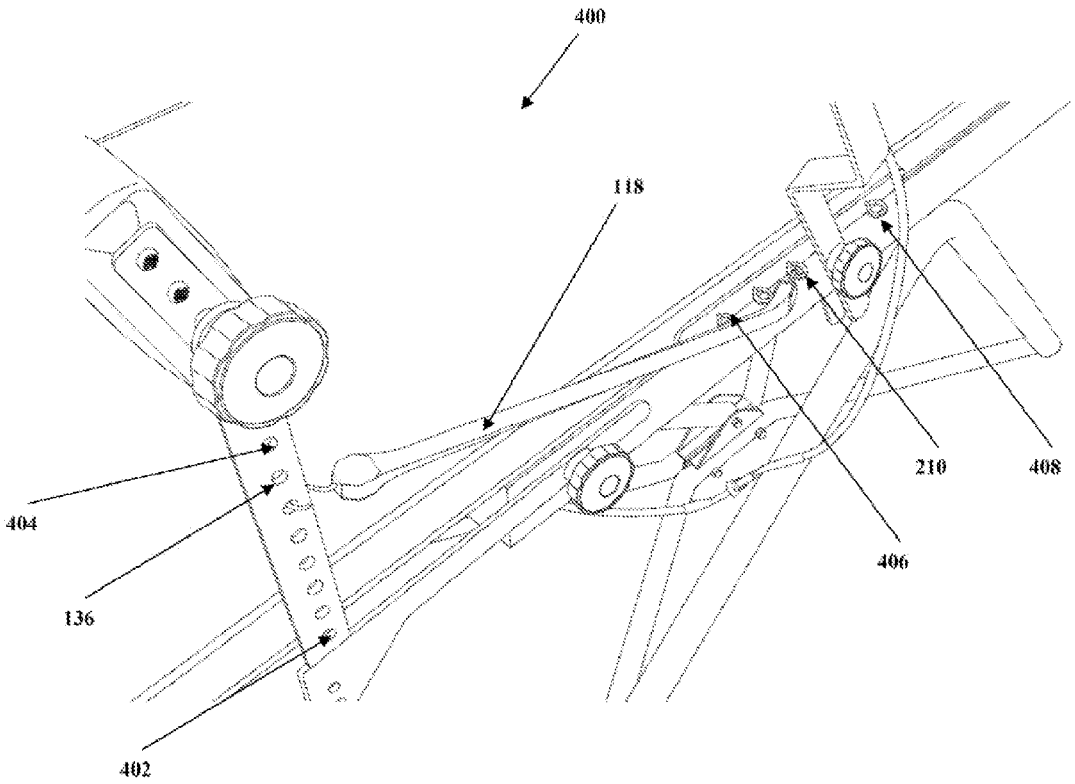
FIG. 4 shows an illustration of the perspective view in detail of the variable resistance connectors at both the fixed and slidable portions of the device, according to an exemplary embodiment of the invention.

FIG. 4 shows details of one possible combination of a rubber band 118 connected at one of the many angles between the angle hook 136 openings to the movable bed 106 hooks 210. The ability to place the same band 118 at varying angles (effectively altering the resistance by the sine/cosine trigonometric aspect), affords among many the advantage of allowing a user to use the same belts with multiple powers of resistance. Thus a band 118 placed almost horizontal, say from hooks 404 to 406, will have less resistance than the same band between hooks 404 to 408, yet a completely different feeling than the same belt from 402 to 406 and/or 408. In addition, a user may fit one type (or the same) of band 118 from 402 to 406, and a second from 404 to 408 without these interfering with each other.

Figure 5:
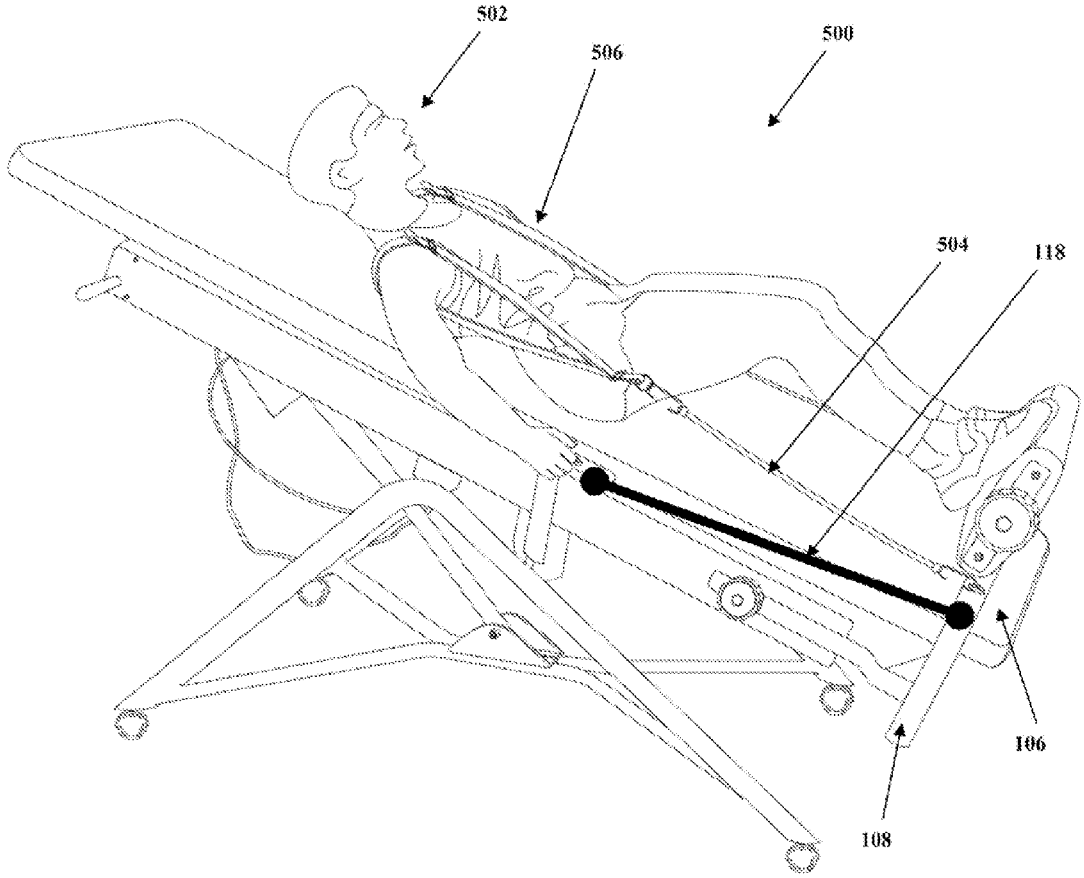
FIG. 5 shows an illustration of a perspective view of the a user using the tiltable multi-purpose variable resistance exercise gym apparatus in combination with a shoulder strap assembly of variable resistance, according to an exemplary embodiment of the invention.

In this fashion, we see in FIG. 5 we an exercise face-up position 500 where the user 502 has a combined exercise position where the user 502 is able to perform leg push exercises while having resistance bands 504 connected to an harness 506 placed around said user's 502 shoulders. The position of the user 504 above the table 106 then allows the user to move up/down with the table. The addition of the variable resistance bands 118 between the angle connection 108 and the bed or table 106 then allows for an additional level of resistance.

Figure 6:
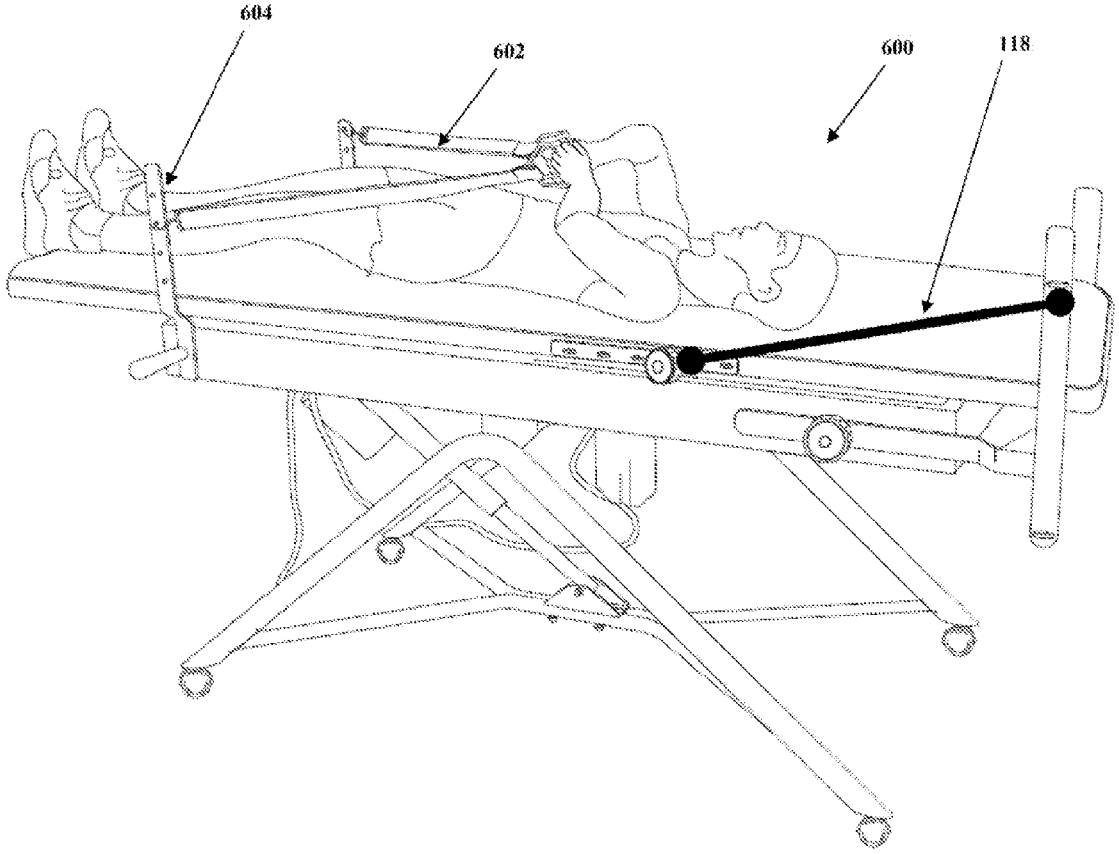
FIG. 6 shows an illustration of a perspective view of a user in another exercise combination, according to an exemplary embodiment of the invention.

Another exercise can be seen in FIG. 6 where another exercise with the user 502 in a face-up position 600. In one embodiment, user fixed resistance bands 602 are attached to posts 604 attached to the support frame 102 with the moving of the table 106 (connected to the user 502), with the resistance of the table movement being augmented by the selected angle/position of the variable resistance bands 118. In an alternate embodiment, the user resistance bands 602 may be comprised of variable resistance bands.

Figure 7:
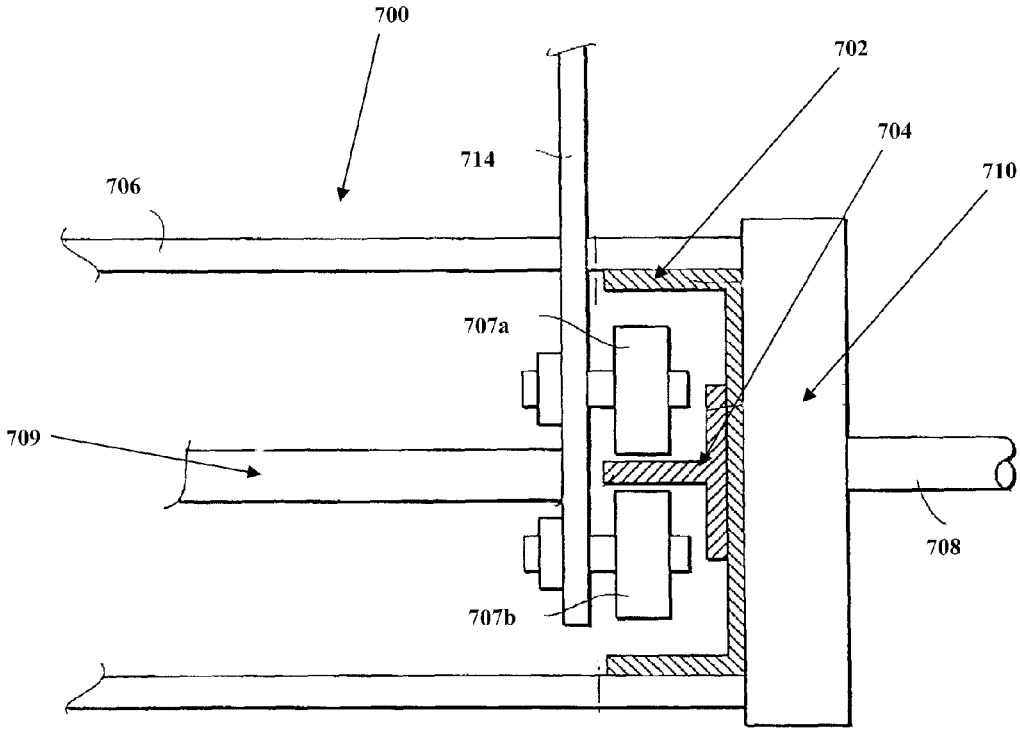
FIG. 7 is an end sectional view showing a roller and track arrangement which supports the slidable table member on the tiltable chassis.
Figure 8:
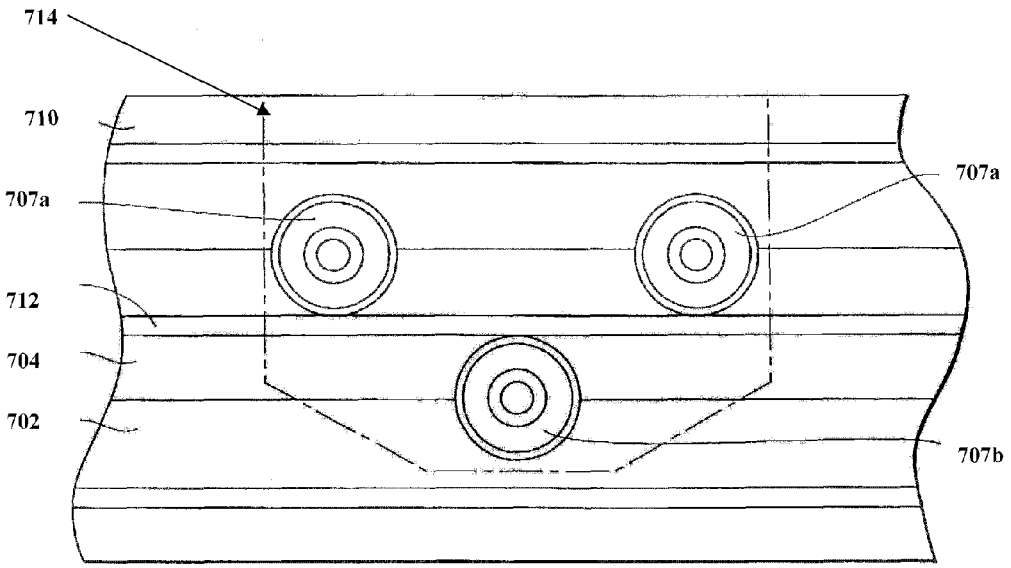
FIG. 8 is a side sectional view of the roller and track arrangements.

As will be appreciated from FIGS. 7-8, the sides of the chassis 104 in this particular instance are formed of channel members 702 in which smaller pieces of T-section channel 704 are rigidly connected. The channel members 702 are interconnected by suitably spaced laterally extending brace members 706. Sets of rollers which comprise two upper support rollers 707*a* and one lower retaining roller 707*b*, are provided on each of the four support brackets 708 and are arranged to roll along the rails 712 provided by the mirror image T-section channel 704 which are provided on either side of the chassis 104. Braces 709 extend between pairs of support brackets 714 to prevent flexure of the brackets 714 when the table 106 is moving under load. The cover covers or enclosures 710.

In one embodiment the chassis 104 is supported on the base/support frame 102 by two stub pivot shafts 708 which are connected at their inboard ends to the chassis 104 and which pass through mounting brackets. In another embodiment, in order to reduce noise, the rollers 707*a*, 707*b* can be roller bearing type rollers such as those used on skate boards having Nylon® or hard rubber tires. Alternatively, the rollers 707*a*, 707*b* can have steel tires and the T-section channel 704 lined on both the upper and lower sides with a suitable elastomeric sound deadening material.

The tilt control 112 in this embodiment features an extendible strut 122 which is mechanically connected to an electric motor 120 through suitable step down-gearing. The energization and direction of rotation of the motor 120 is controlled by the remote hand-held controller 114 which is connected with the motor 120 through a control cable or as a wireless control unit.

Both the upper and lower ends of the extensible strut 122 are connected to the tiltable chassis 104 and the base frame 102 by way of pivoting the angle relationship, to allow for the change in angle which occurs with tilting of the chassis 104. In one embodiment, the extensible strut 122 includes a helically threaded male member which is threaded into a female member that is provided internally with a corresponding helical thread.

In one embodiment the foot rest 116 can be adjusted both in a direction to allow for different leg lengths as well as vertically adjustable so as to allow the height of the foot position to be selectively increased. A pair of rowing oar anchor brackets 124 are fixedly connected to the sides of the chassis 104. The lower ends of these brackets 124 are provided with suitable "oar" anchor pins 128 which allow the selective connection of lever or oar members 126.

The "head" end H/E of the chassis 130 is provided with a pair of horizontally extending bicycle-type hand grips 132. Adjacent these handles 132 are a pair of sockets into which cable connector brackets 134 are insertable. As shown, the cable connector brackets 134 are provided with a series of holes which allow fixed or variable resistance cables or straps to be connected at different heights and used to enable various types of arm exercises to be carried out.

CONCLUSION

In concluding the detailed description, it should be noted that it would be obvious to those skilled in the art that many variations and modifications can be made to the preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

What is claimed is:

1. An exercising machine comprising;

a support frame;

a chassis supported on said support frame so as to be selectively tiltable at an angle with respect to a horizontal plane, an angle connector connected to each side of said chassis, said angle connector having two or more angle connector hook positions along its vertical length;

a slidable table slidably supported on the tiltable chassis, said table being adapted to support a person and to be tiltable at the same angle as said chassis;

a motorized tilt control arrangement which controls the angle of inclination of the combined chassis and slidable table arrangement, said angle adjustment device interconnecting said support frame and said chassis and maintaining a selected tilt angle of said chassis with respect to the horizontal plane;

a pair of oar anchor brackets which are fastened to each side of said chassis, said oar anchor brackets having connection means which enables the lower ends of handles to be pivotally connected to said chassis; and two or more table hook positions mechanically attached and placed along each side of said table, one or more adjustable resistance band connecting one said table hook position to one said hook position along said angle connector, said resistance bands being the only mechanism resisting movement of said slidable table on said chassis.

2. An exercising machine as set forth in claim 1, wherein;

said table is supported on said chassis by a plurality of rollers, and wherein said chassis is provided with rail means on which said rollers can roll.

3. An exercising machine as set forth in claim 2, wherein;

said rollers are arranged in sets wherein a plurality of rollers of each set are arranged to roll on to of said rail means, and at least one roller of each set is arranged to roll on the lower side of said rail means.

4. An exercising machine as set forth in claim 3, wherein;

said table is supported on said chassis by a plurality of rollers, and wherein said chassis is provided with rail means on which said rollers can roll.

5. An exercising machine as set forth in claim 4, wherein;

said rollers are arranged in sets wherein a plurality of rollers of each set are arranged to roll on top of said rail means, and at least one roller of each set is arranged to roll on the lower side of said rail means.

6. An exercising machine as set forth in claim 1, wherein;

one said set of adjustable resistance bands connects one said table hook position to one said angle connector hook position above the plane of said table; and one said set of adjustable resistance bands connects one said table hook position to one said angle connector hook position below the plane of said table.

7. An exercising machine as set forth in claim 6, wherein;

said adjustable resistance hands are bungee cords.

* * * * *